US005358173A

United States Patent [19]

Mertz

[11] Patent Number: 5,358,173

[45] Date of Patent: Oct. 25, 1994

[54] CONTAINER CLOSURE FLAP ARRANGEMENT

[75] Inventor: Noel J. Mertz, Geneva, Ill.

[73] Assignee: Jefferson Smurfit Corporation, Clayton, Mo.

[21] Appl. No.: 186,859

[22] Filed: Mar. 22, 1994

[51] Int. Cl.[5] ..... B65D 5/24; B65D 5/66

[52] U.S. Cl. ..... 229/110; 229/149; 229/150; 229/186; 229/906

[58] Field of Search ..... 229/109, 110, 144; 149, 229/150, 151, 186, 902, 906

[56] References Cited

U.S. PATENT DOCUMENTS

| | | | |
|---|---|---|---|
| 2,189,151 | 2/1940 | Platt | 229/906 |
| 2,973,858 | 3/1961 | Laneve et al. | 229/149 |
| 3,162,142 | 3/1964 | Goetz | 229/186 |
| 4,765,534 | 8/1988 | Zion et al. | 229/906 |
| 4,809,908 | 3/1989 | Keefe et al. | 229/150 |
| 4,984,734 | 1/1991 | Zion et al. | 229/109 |
| 5,000,374 | 3/1991 | Deiger | 229/906 |
| 5,110,039 | 5/1992 | Philips | 229/110 |
| 5,118,032 | 6/1992 | Geho | 229/110 |
| 5,211,329 | 5/1993 | Patton | 229/110 |
| 5,263,634 | 11/1993 | Korine | 229/109 |

FOREIGN PATENT DOCUMENTS

| | | | |
|---|---|---|---|
| 3933372 | 4/1991 | Fed. Rep. of Germany | 229/109 |

*Primary Examiner*—Gary E. Elkins
*Attorney, Agent, or Firm*—Richard W. Carpenter

[57] ABSTRACT

A one-piece, collapsible, tray type, paperboard container, with truncated front corners. The container includes a pair of hingedly interconnected tray and cover members, each having a pair of side wall panels, and a pair of closure flaps with side portions that overlap the ends of the cover side wall panels to maintain them in place against the outer surfaces of the tray side wall panels when the container is in a closed condition.

10 Claims, 2 Drawing Sheets

CONTAINER CLOSURE FLAP ARRANGEMENT

BACKGROUND OF THE INVENTION

1. Field of the Invention

This invention relates to tray type containers and, more particularly, to an improved closure flap arrangement for a tray type container with truncated corners.

2. Description of the Background Art

A background art search directed to the subject matter of this invention conducted in the United States Patent and Trademark Office disclosed the following U.S. Pat. Nos.: 2,707,586, 4,265,393, 4,765,534, 4,919,326, 5,000,374, 5,211,329.

None of the patents uncovered in the search discloses a one-piece, collapsible, tray type, paperboard container, with truncated front corners, and including hingedly interconnected tray and cover members, each having a pair of side wall panels, and a pair of closure flaps having convexly curved side edges that overlap the ends of the cover side wall panels to maintain them in place against the outer surfaces of the tray side wall panels.

SUMMARY OF THE INVENTION

It is a primary object of the invention to provide an improved closure flap arrangement for a collapsible paperboard container including hingedly interconnected tray and cover members formed from a unitary blank of foldable paperboard and having a pair of truncated front corners.

Another object of the invention is the provision of a container of the type described wherein the tray and cover members have side wall panels held in position against each other, when the container is closed, by the closure flaps.

A more specific object of the invention is to provide a tray type container, with a pair of truncated front corners, wherein the closure flaps have curved side edges that overlap end portions of the cover side wall panels to keep them in position against the tray side wall panels, when the tray and cover are in a closed condition.

These and other objects of the invention will be apparent from an examination of the following description and drawings.

It will be understood that, for purposes of clarity, certain elements may have been omitted from certain views where they are believed to be illustrated to better advantage in other views.

DESCRIPTION OF THE PREFERRED EMBODIMENT

Figure 1:
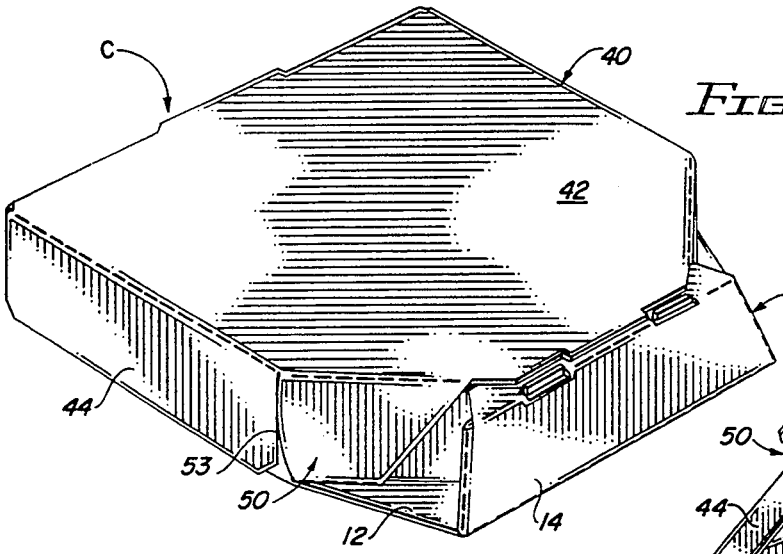
FIG. 1 is an isometric view of a tray type container embodying features of the present invention, with the container shown in a closed condition.
Figure 2B:
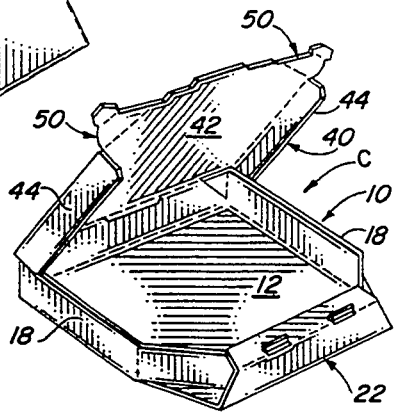
FIGS. 2A–2D are isometric views illustrating the sequential steps required to erect the container illustrated in FIG. 1.
Figure 2A:
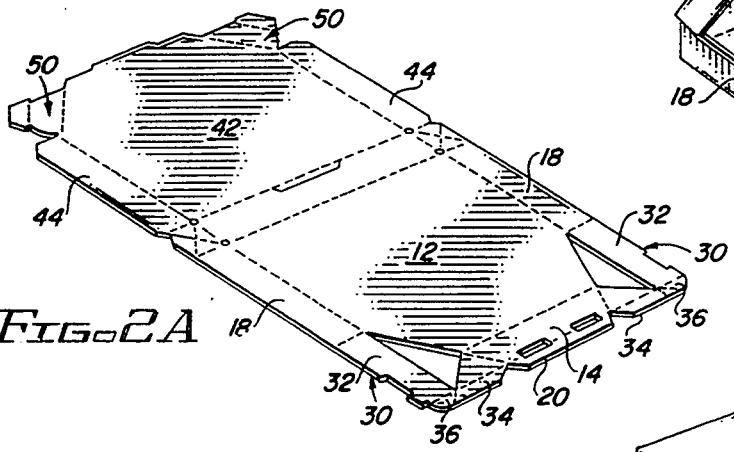
Figure 2C:
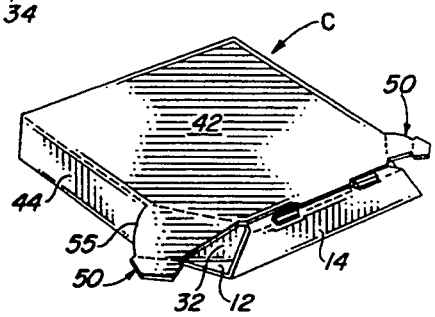
Figure 3:
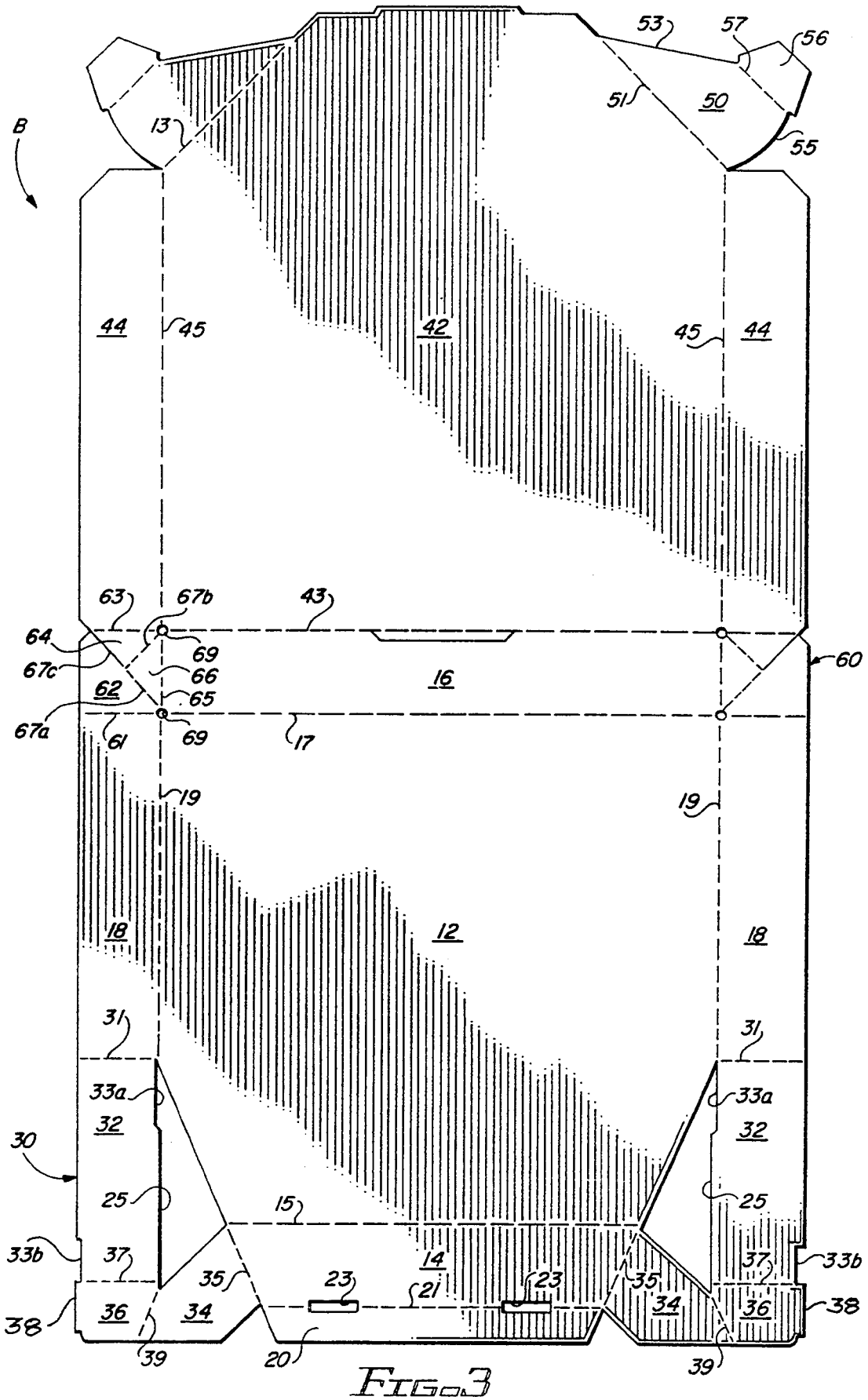
FIG. 3 is a plan view of the paperboard blank from which the container illustrated in the other views may be formed.

Referring now to the drawings for a better understanding of the invention, it will be seen that the tray type container, embodying features of the invention and indicated generally at C in FIGS. 1 and 2A–2D, may be formed from the unitary blank of foldable paperboard indicated generally at B in FIG. 3.

As best seen in FIG. 2B, tray 10 includes a hexagonal bottom wall panel 12 with a front wall panel 14 and a rear wall panel 16 foldably joined to front and rear edges along fold lines 15 and 17, respectively; and a pair of side wall panels 18, foldably joined to opposed side edges thereof along fold lines 19. Panel 12 has a pair of truncated front corners defined by diagonal edges 13.

A retaining flap 20 is foldably joined to front wall panel 14 along fold line 21 to form an L-shaped front wall 22. Again referring to FIG. 3, it will be seen that portions of the front wall retaining flap are cut out to provide a pair of lock tab receiving recesses 23, located adjacent fold line 21.

As best seen in FIGS. 2A and 3, the front ends of the tray side wall panels are spaced from the adjacent ends of the front wall panel but are connected thereto by unique three-section gussets, indicated generally at 30.

It will be seen that the gussets are each generally V-shaped, with inboard edges separated from adjacent front corner edges 13 of the tray bottom wall panel 12 to define an opening 25 therebetween.

Each gusset 30 includes a first or side section 32, foldably joined along a fold line 31, to a front edge of tray said wall panel 18; a second or front section 34, foldably joined along a fold line 35, to a side edge of tray front wall panel 14; and a third or corner section 36, foldably joined along a fold line 37 to first section 32, and foldably joined along a fold line 39 to second section 34.

The lower edge of each first section 32 may be recessed, as indicated at **33*a*, for receipt of a locking tab, and the upper edge may be recessed, as at 33*b*, for receipt of a portion of front wall retaining flap 20**, as hereinafter described.

Each gusset third section may be provided, at its upper edge, with a projection 38 that serves as a lock tab which is receivable within an opening 23 in the tray front wall retaining flap 20 to provide an interlocking connection between the tray side wall panel and the front wall, as hereinafter described.

As seen in FIGS. 2A and 3, container C includes a cover 40 having a top wall panel 42, foldably joined along fold line 43 to the upper edge of tray rear wall panel 16; and a pair of side wall panels, 44 foldably joined along fold lines 45, to opposed side edges of top wall panel 42.

The essence of the present invention resides in the provision of a pair of unique closure flaps 50, having inner edges foldably joined on fold lines 51 to front corner edges of cover top wall panel 42, and having arrow shaped lock tabs 56 foldably joined along fold lines 57 to their respective outer edges.

As best seen in FIG. 3, each closure 50 has a straight front side edge 53 and a convexly curved rear side edge 55.

Although the tray side wall panels may be connected to the tray rear wall panel in different ways, in this application the tray side wall panels 18 are shown connected to the tray rear wall panel 16 by a pair of webs, indicated generally at 60.

Each web 60, includes three triangular sections: a first section 62, foldably joined on a fold line 61 to a related tray side wall panel 18; a second section 64, foldably joined on a fold line 63 to a related cover side wall panel 44; and a third section 66, foldably joined on a fold line 65 to a rear wall panel 16 of tray 10.

Web third section 66 is also foldably joined along fold lines 67*a* and 67*b* to adjacent edges of web first and second sections 62 and 64, respectively. Also, web first section is separated from web second section by a cut line 67*c*.

To facilitate folding of the web sections on closure of the cover, a pair of openings may be provided in blank B at opposite ends of fold lines 65, where they intersect fold lines 61 and 63.

In order to erect the tray, the front wall panel 14 and the side wall panels 18 are folded upwardly from the bottom wall panel. At the same time gusset second and third sections 34 and 36 are folded inwardly until second section 34 lies against the inner or rear surface of front wall panel 14, and third section 36 lies against portions of the inner or rear surfaces of both second section 34 and front wall panel 14. As this occurs gusset first sections 32 are folded inwardly to lie over the front corners of tray bottom wall panel 12 inboardly of diagonal corner edges 13.

At this time tray front wall retaining flap 20 is folded inwardly 90 degrees with the gusset third section lock tabs being engaged in the respective front wall recesses 23, and the ends of the retaining flap being received within the respective gusset first section recesses 33*b*.

In order to close the container cover, after the container has been filled, the tray rear wall panel 16 is folded to the vertical position. As this occurs the webs 60 interconnecting the tray rear and side wall panels will automatically move inwardly with the web second and third sections 64 and 66 lying in face-to-face relation with each other between the web first section 62 and the tray rear wall panel 16.

The cover can then be locked to the tray by folding the closure flaps 50 downwardly and folding the lock tabs 56 inwardly and inserting them under the respective gusset first sections 32 in related recesses 33*a*.

Figure 4:
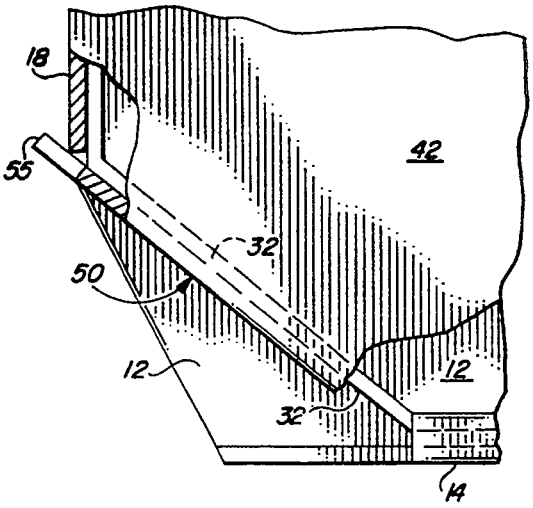
FIG. 4 is a horizontal cross-sectional view taken on line 4—4 of FIG. 2D.
Figure 2D:
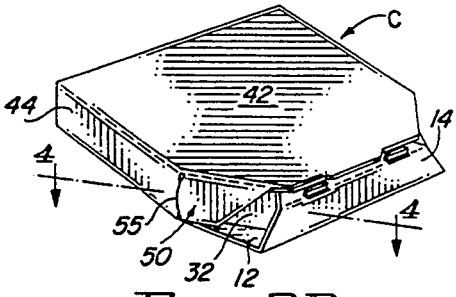

As best seen in FIGS. 2B and 4, when the container is in a closed condition, the cover side wall panels 44 are positioned outboardly adjacent and parallel to tray side wall panels 18.

The novel configuration of the closure 50, with the curved rear side edges 55, provides additional material in the flaps 50 which extends rearwardly beyond the front edges of the cover side wall panels 44 and overlaps enough of the cover side wall panels to hold them in place snugly against the side wall panels of the tray, when the container is in a closed condition.

What is claimed is:

1. An improved closure flap arrangement for a tray type container with truncated front corners, said container being formed from a unitary blank of foldable paperboard and comprising:

(a) a tray member including a bottom wall panel having a front wall panel, a rear wall panel, and a pair of side wall panels foldably joined to front, rear, and side edges, respectively, thereof and upstanding therefrom;

(b) a cover member including a top wall panel having a rear edge foldably joined to an upper edge of said tray member rear wall, and having a pair of side wall panels foldably joined to side edges thereof and depending therefrom;

(c) a pair of closure flaps foldably joined to diagonally extending front corner edges of said cover member top wall and extending downwardly therefrom, when the container is in a closed condition;

(d) said closure flaps each having:

(i) a lock tab foldably joined to a lower edge thereof and arranged and disposed to be tucked into a related recess of said tray member;

(ii) a curved rear side edge extending rearwardly beyond and overlapping forward edges of said cover member side wall panels to maintain said cover side wall panels against said tray side wall panels when said container is in a closed condition.

2. A closure flap arrangement according to claim 1, wherein said closure flap curved rear side edge is convex.

3. An improved closure flap arrangement for a tray type container with truncated front corners, said container being formed from a unitary blank of foldable paperboard and comprising:

(a) a tray member including a bottom wall panel having a front wall panel, a rear wall panel, and a pair of side wall panels foldably joined to front, rear, and side edges, respectively, thereof and upstanding therefrom;

(b) a cover member including a top wall panel having a rear edge foldably joined to an upper edge of said tray member rear wall, and having a pair of side wall panels foldably joined to side edges thereof and depending therefrom;

(c) a pair of closure flaps foldably joined to diagonally extending front corner edges of said cover member top wall and extending downwardly therefrom, when the container is in a closed condition;

(d) said closure flaps each having:

(i) an end portion arranged and disposed to be tucked into a related recess of said tray member;

(ii) one side portion extending rearwardly beyond and overlapping forward edges of said cover member side wall panels to maintain said cover side wall panels against said tray side wall panels when said container is in a closed condition.

4. A closure flap arrangement according to claim 6, wherein each of said closure flaps has a curved rear side edge.

5. A closure flap arrangement according to claim 4, wherein said closure flap curved rear side edge is convex.

6. An improved closure flap arrangement for a tray type container with truncated front corners, said container being formed from a unitary blank of foldable paperboard and comprising:

(a) a tray member including a bottom horizontal wall panel having a pair of side wall panels foldably joined to side edges thereof and upstanding therefrom;

(b) a cover member including a top horizontal wall panel having a pair of side wall panels foldably joined to side edges thereof and depending therefrom;

(c) a pair of closure flaps foldably joined to diagonally extending front corner edges of the horizontal wall panel of one of said members and extending toward the horizontal wall panel of the other of said members, when the container is in a closed condition;

(d) said closure flaps each having:

(i) an end portion arranged and disposed to be tucked into a related recess of said other member;

(ii) one side portion extending rearwardly beyond and overlapping forward edges of certain of said side wall panels to maintain the side wall panels of said members against each other, when said container is in a closed condition.

7. A closure flap arrangement according to claim 6, and including a rear wall panel foldably joined, at a lower edge, to a rear edge of said tray member horizontal wall panel and foldably joined, at an upper edge, to a rear edge of said cover member horizontal wall panel.

8. A closure flap arrangement according to claim 6, wherein said closure flaps are foldably joined to diagonally extending front corner edges of said cover member horizontal wall panel.

9. A closure flap arrangement according to claim 6, wherein each of said closure flaps has a curved rear side edge.

10. A closure flap arrangement according to claim 9, wherein said closure flap curved rear side edge is convex.

* * * * *